US007653324B2

(12) United States Patent
Sagi

(10) Patent No.: US 7,653,324 B2
(45) Date of Patent: Jan. 26, 2010

(54) SCHEDULING FOR A DUAL SIDED PRINTING BY A DUAL ENGINE PRINTER

(75) Inventor: Dani Sagi, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1005 days.

(21) Appl. No.: 11/155,935

(22) Filed: Jun. 17, 2005

(65) Prior Publication Data

US 2006/0285133 A1 Dec. 21, 2006

(51) Int. Cl.
*G03G 15/00* (2006.01)

(52) U.S. Cl. ..... 399/82

(58) Field of Classification Search ..... 399/82, 399/401, 298, 299
See application file for complete search history.

(56) References Cited

U.S. PATENT DOCUMENTS 5,809,363 A * 9/1998 Kitamura et al. ..... 399/8
6,192,202 B1 * 2/2001 Doi ..... 399/8

* cited by examiner

*Primary Examiner*—Quana M Grainger

(57) ABSTRACT

A dual engine color printer has two print engines, one for printing each side of the sheet. Each engine comprises a single multi-color set of printing drums—a set meaning a PIP drum, a blanket and an impression drum. A scheduling method is provided for imbalanced duplex printing of sheets in a print job, imbalanced meaning that the two sides of the sheets requires different numbers of colors. This conventionally leads to a situation in which one engine would have to wait until the other engine has finished. The method comprises feeding the sheets in sequence between the print engines, and alternating, over the sequence of engines, between printing the upside of a sheet followed by the down side for even sheets and the downside followed by the upside for odd sheets. Thus the two print engines are utilized full time and are not left idle while waiting for each other.

9 Claims, 4 Drawing Sheets

SCHEDULING FOR A DUAL SIDED PRINTING BY A DUAL ENGINE PRINTER

FIELD AND BACKGROUND OF THE INVENTION

The present invention relates to a method or apparatus for scheduling for a dual engine printer and, more particularly, but not exclusively to a dual engine printer that prints multi-colored spreads in a series of separations wherein all of the separations are carried out using a single drum set.

Dual engine printers are printers that have dual printing engines or dual sets of drums for printing. Typically dual engine printers are used in double sided, or duplex, printing, such that the one side of the sheet is printed using one engine and then the sheet is passed on to the second engine for the printing on the second side.

Conventional dual engine color printers have a series of printing drums or drum sets, one set for each color. Thus a four color printer has four drum sets in each engine.

A color printer used by the present inventors uses a drum set that has a drum set for each printing engine, the set comprising an organic photoconductive (OPC) drum, otherwise known as a photo imaging plate (PIP) drum, a blanket drum, and an impression drum.

The above color printer uses a single drum set in each engine that prints multi-colored spreads in a series of separations. Thus each of the engines of the dual engine printer comprises a single set of the Photo imaging plate (PIP) drum, blanket and impression drums. The print medium, or sheet, approaches the impression drum and is wrapped thereon. In a series of rotations the sheet passes the nip or image transfer position several times, each time receiving an image from the blanket in a different color. Once the full range of colors has been printed the sheet is removed from the impression drum and inverted as necessary for the second engine where the same procedure is repeated for the second side.

Now it is quite typical in duplex color printing, that only one side of the sheet has a color image. The second side is monochrome. Thus in color magazines for example, it is quite common to have a color image on one side only, with text on the reverse side.

In such a case a conventional dual engine printer that may have separate impression drums for each color simply passes the sheets through the engine one by one in the usual way. For monochrome printing no image is transferred by the remaining color drums.

However where each engine comprises a single drum set that does multiple colors, the sheet is detained at the impression drum for the number of rotations equaling the number of colors. The system operates smoothly as long as both sides require the same number of colors, but color-one-side monochrome-one-side printing leads to an imbalance in the utilization of the drums since one engine has to wait until the other has finished, slowing down the throughput of the sheets.

Thus by example we consider a print job requiring numerous sheets to be printed with a 6-color image on the first side and a monochrome image on the second side. The first sheet reaches the first engine where the 6-color image is to be added. The sheet is detained for six separate rotations of the drum during which time the second engine does nothing. Then the sheet is passed on to the second engine and a new sheet is taken by the first engine. The second engine performs a single drum rotation for its monochrome printing. The second engine's drum performs its single monochrome rotation simultaneously with the first rotation of the first engine for its second spread, but the second engine still has to wait idly for five more rotations, whilst the first engine continues to print its second color image, before the second can receive the second sheet. Thus the second engine spends 83.3% of its time idling and the overall utilization of the dual engine printer is reduced. Printing takes six rotations per sheet with no saving due to the fact that one side requires fewer colors.

U.S. Pat. No. 5,710,635 discloses a general purpose scheduling algorithm for a dual engine printer. It is applicable to situations having double sided and color printing. However, it is not specifically applicable to the present situation nor does it suggest a solution to the above problem.

U.S. Pat. No. 6,259,884 teaches a complex system for duplex printing which allows for improved printing efficiency. However, the system taught suffers from undue complexity.

U.S. Pat. No. 5,568,246 describes a dual engine printer and a method for scheduling single sided printing thereon by sending alternate sheets to the different engines. The result is greater utilization of the dual engine printer, but there is no teaching of how the method could be modified for unbalanced dual sided printing.

There is thus a widely recognized need for, and it would be highly advantageous to have, a dual engine single drum set color printing system devoid of the above limitations.

SUMMARY OF THE INVENTION

According to one aspect of the present invention there is provided, in a dual engine color printer having a first print engine and a second print engine, each engine comprising a single multi-color printing drum set, a scheduling method for imbalanced dual sided printing of a plurality of sheets in a print job, in which a first side of each sheet of the plurality requires a first set of separations and a second side thereof requires a second set of separations, the first and second sets having different numbers of separations, the method comprising:

feeding respective ones of the plurality of sheets in sequence between the print engines, and alternating for successive sheets between printing the first set at the first engine and the second set at the second engine on the one hand and printing the second set at the first engine and the first set at the second engine on the other hand.

In an embodiment, the feeding and alternating comprises repetitively until the print job is complete:

feeding one of the plurality of sheets to the first engine, and printing the first number of separations on a first side thereof;

subsequently, feeding the one sheet to the second engine, and printing the second number of separations on a second side thereof;

simultaneously with the feeding of the first sheet to the second engine, feeding a following one of the plurality of sheets to the first engine, and printing the second number of separations on a first side thereof; and subsequently feeding the following sheet to the second engine, and printing the first number of separations on a second side thereof.

The method may further comprise inverting respective alternate sheets for output.

The method may further comprise feeding respective alternate sheets to alternate output sites.

According to a second aspect of the invention there is provided a controller for a dual engine color printing machine, the dual engine printing machine comprising a first color print engine and a second color print engine, each engine comprising a single multi-color printing drum, the controller having a mode for imbalanced dual sided printing, the imbalanced dual sided printing being a case in which a first side of each sheet of the plurality requires a first set of separations and a second side thereof requires a second set of separations, the first and second sets having different numbers of separations, the mode comprising:

a control operation applied to a sheet feeding mechanism for feeding respective ones of the plurality of sheets in sequence between the print engines, and a control operation applied to the engines for alternating for successive sheets between printing the first set at the first engine and the second set at the second engine on the one hand and printing the second set at the first engine and the first set at the second engine on the other hand.

The control operation of feeding and alternating applied to the engines may comprise repetitively until the print job is complete:

feeding one of the plurality of sheets to the first engine, and printing the first number of separations on a first side thereof;

subsequently, feeding the one sheet to the second engine, and printing the second number of separations on a second side thereof;

simultaneously with the feeding of the first sheet to the second engine, feeding a following one of the plurality of sheets to the first engine, and printing the second number of separations on a first side thereof; and subsequently feeding the following sheet to the second engine, and printing the first number of separations on a second side thereof.

The controller may be configured to provide an output feed signal to control output feeding of the sheets such as to invert alternate sheets between printing and output.

The controller may be configured to provide an output feed signal to control output feeding of the sheets to deliver alternate sheets to different output sites.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected scheduling tasks or steps manually, automatically, or a combination thereof. Moreover, according to actual instrumentation and equipment of preferred embodiments of the method and system of the present invention, the scheduling steps could be implemented by hardware or by software on any operating system or any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
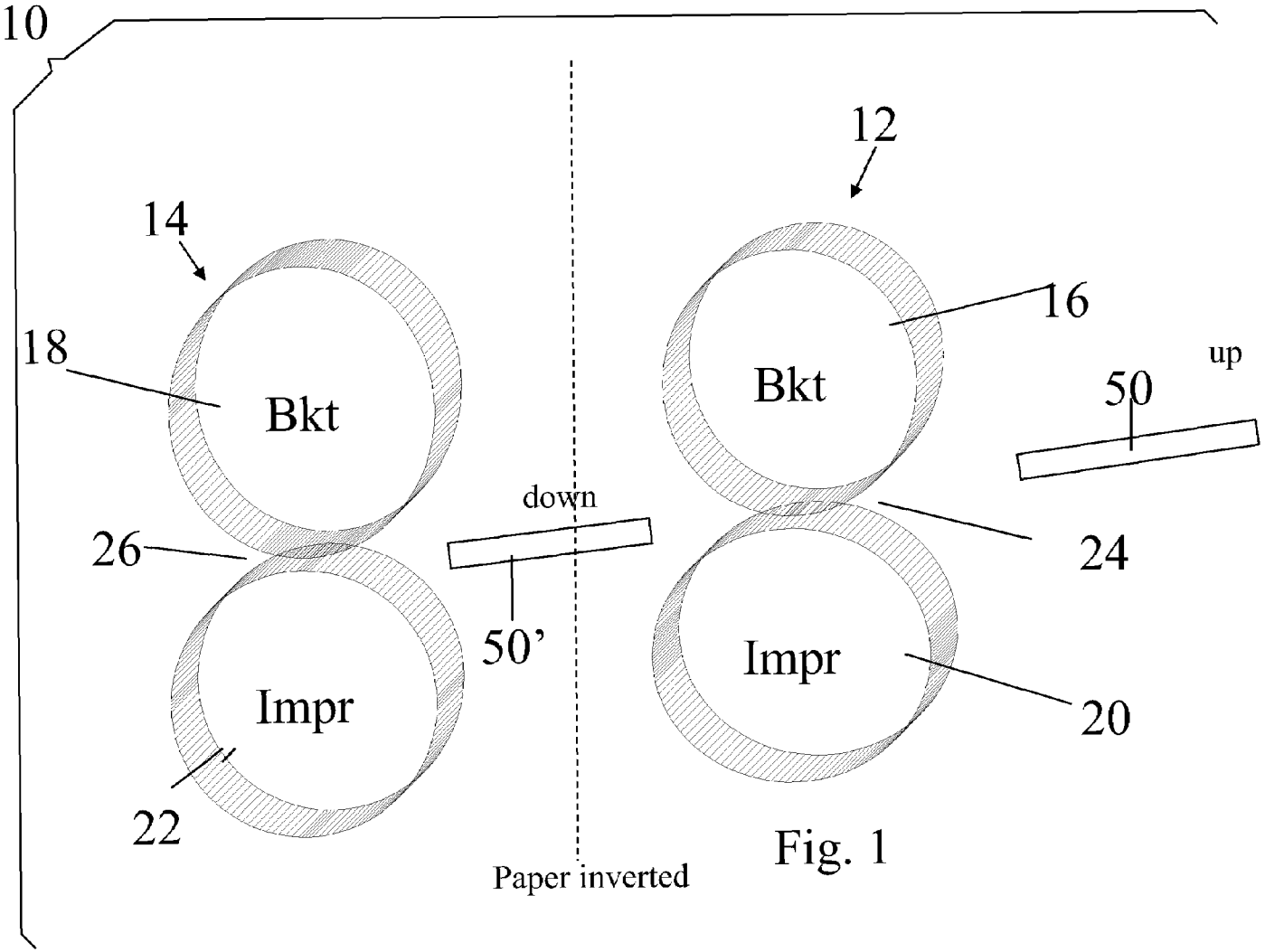
FIG. 1 is a simplified diagram showing a dual engine printer and a first sheet being fed through said engines according to a first embodiment of the present invention.

The present embodiments comprise a scheduling system or method for imbalanced dual sided printing for a dual engine color printer in which each engine comprises one set of print drums. Herein the set of print drums refers to formation involving an PIP drum for forming the image, a blanket in which the image is transformed into ink, and an impression drum which applies the sheet to the blanket. The single set of drums provides multiple colors in multiple separations. In imbalanced printing the engines are scheduled to alternate respectively between printing the two sides of the sheet so that both engines are working at full utilization. That is to say one engine prints the upside of one sheet and the downside of the next sheet. The other engine prints the downside of the first sheet and the upside of the next sheet, the cycle being repeated for the entire print job.

The principles and operation of a scheduling system according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1, which is a schematic view of the internal workings of a dual engine color printer. The printer 10 has two color printing engines 12 and 14. Each engine has a single PIP drum not shown on which the image is initially electrostatically formed and then developed, a single multi-color blanket drum 16 and 18, which receives the developed image from the PIP drum onto the blanket, and a single impression drum 20 and 22 which contra-rotates to the blanket and which holds the paper or other sheet against the blanket to receive the image. The blanket in fact carries the image to the nip 24, 26. The nip, 24 and 26 respectively, is the point at which the blanket and the impression drums meet, and the image is transferred from the blanket to the printing medium which is located on the impression drum. The image is transferred to the side of the sheet facing the blanket.

Now, as mentioned above, the single drum set is able to apply multi-color printing in a spread comprising a series of separations, one separation for each color. Since the blanket has surface release properties, no residual ink is left, and the blanket can move on to the next color without causing contamination by the previous color. In such a spread, the sheet wraps around the impression drum and each time it passes the nip, a different color image is transferred. Each rotation provides another separation in the spread or color series giving the color image. Thus in a four color spread, meaning four color images are transferred, the impression drum rotates four times with the same sheet, and then receives the next sheet. An advantage of carrying out color printing in this way is that since each of the separate color images is transferred from the same blanket to the same sheet which is still wrapped on the same impression drum it is much easier to ensure that the separate color images are properly registered.

Figure 2:
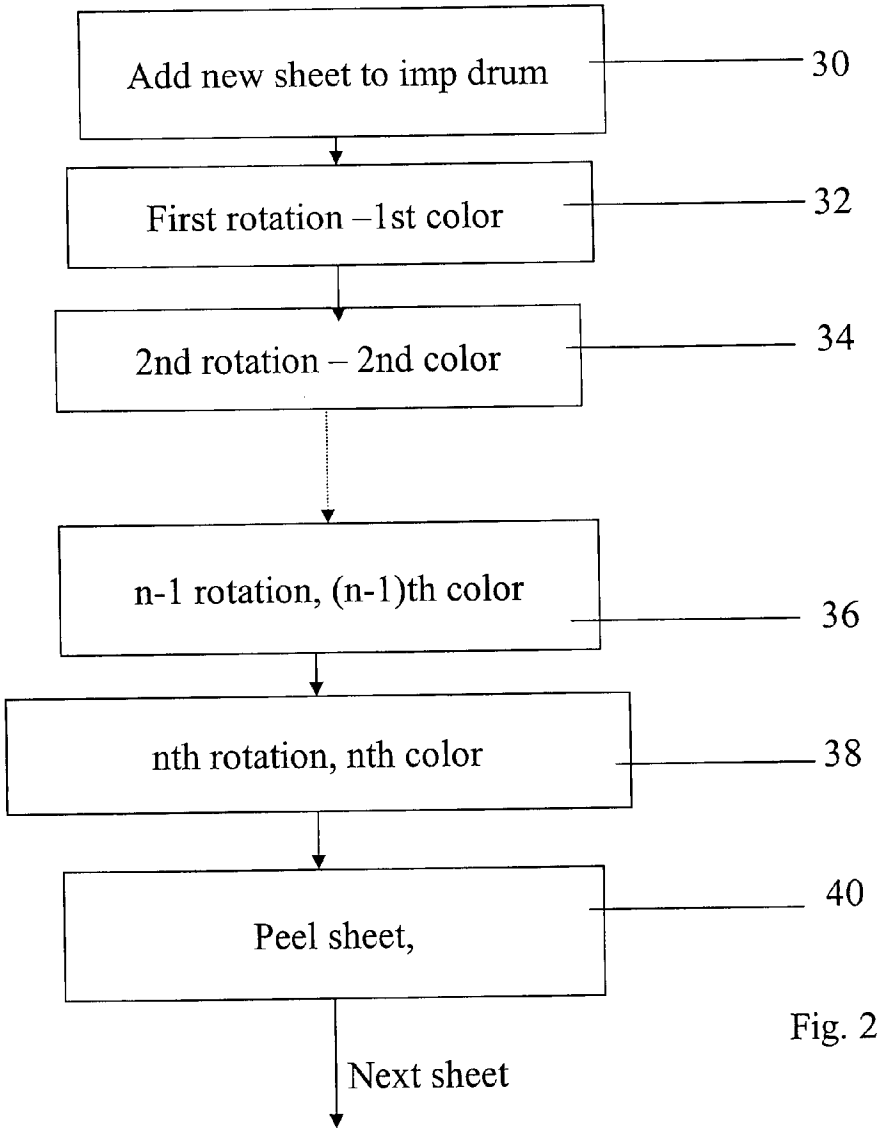
FIG. 2 is a simplified flow diagram illustrating a procedure for printing a multi-colored spread using a single print drum set.

Reference is now made to FIG. 2, which is a simplified flow chart illustrating a color printing spread using a single color print drum. Firstly in a stage 30, a current sheet is loaded onto the print drum. A first impression using a first color ink is applied in stage 32. In additional separations up to n−1, further rotations of the drum involve applications of further impressions, in stages 34 and 36, using further colored inks. Then in stage 38 the nth color impression is applied. In stage 40 the paper is peeled from the drum.

When the procedure of FIG. 2 is applied to dual sided printing, then after the spread has been printed as above at the first print engine, the sheet is inverted and fed to the second print engine, which now proceeds to print the second side in exactly the same way. Returning to FIG. 1, and sheet 50 is fed in a first orientation (marked up) to the first engine. The sheet is then inverted, 50' marked "down", as it passes from the first engine to the second engine. The second engine prints the second side.

Non-optimal usage arises when the dual sided printing is imbalanced, which is to say that the two sides take different numbers of colors. For example the first side may have a color photograph which requires six-color printing and the second side may simply have text, which only requires a single color. In this case the first engine performs six separations on each sheet and the second engine performs only a single separation on each sheet so that the second engine in fact spends most of its time waiting for sheets to arrive from the first engine.

Thus printing using the prior art system proceeds as in the following table:

TABLE 1

Prior art Printing Schedule, 6-1 imbalanced dual side printing

| | Page No | | | |
|---|---|---|---|---|
| | 1 | 2 | 3 | 4 |
| 1st Engine | 6 separations | 6 separations | 6 separations | 6 separations |
| 2nd Engine | 1 separation | 1 separation | 1 separation | 1 separation |
| Wait cycles 2nd Engine | 5 cycles | 5 cycles | 5 cycles | 5 cycles |

As is apparent the second engine spends the majority of the time waiting. If we calculate the efficiency of the dual engine printing system as a whole, we see that the first engine is working at 100% efficiency but that the second engine is working at only a sixth or 16.67% efficiency. Thus the overall efficiency is:

$$(100+16.67)/2=58.33\%.$$

Figure 3:
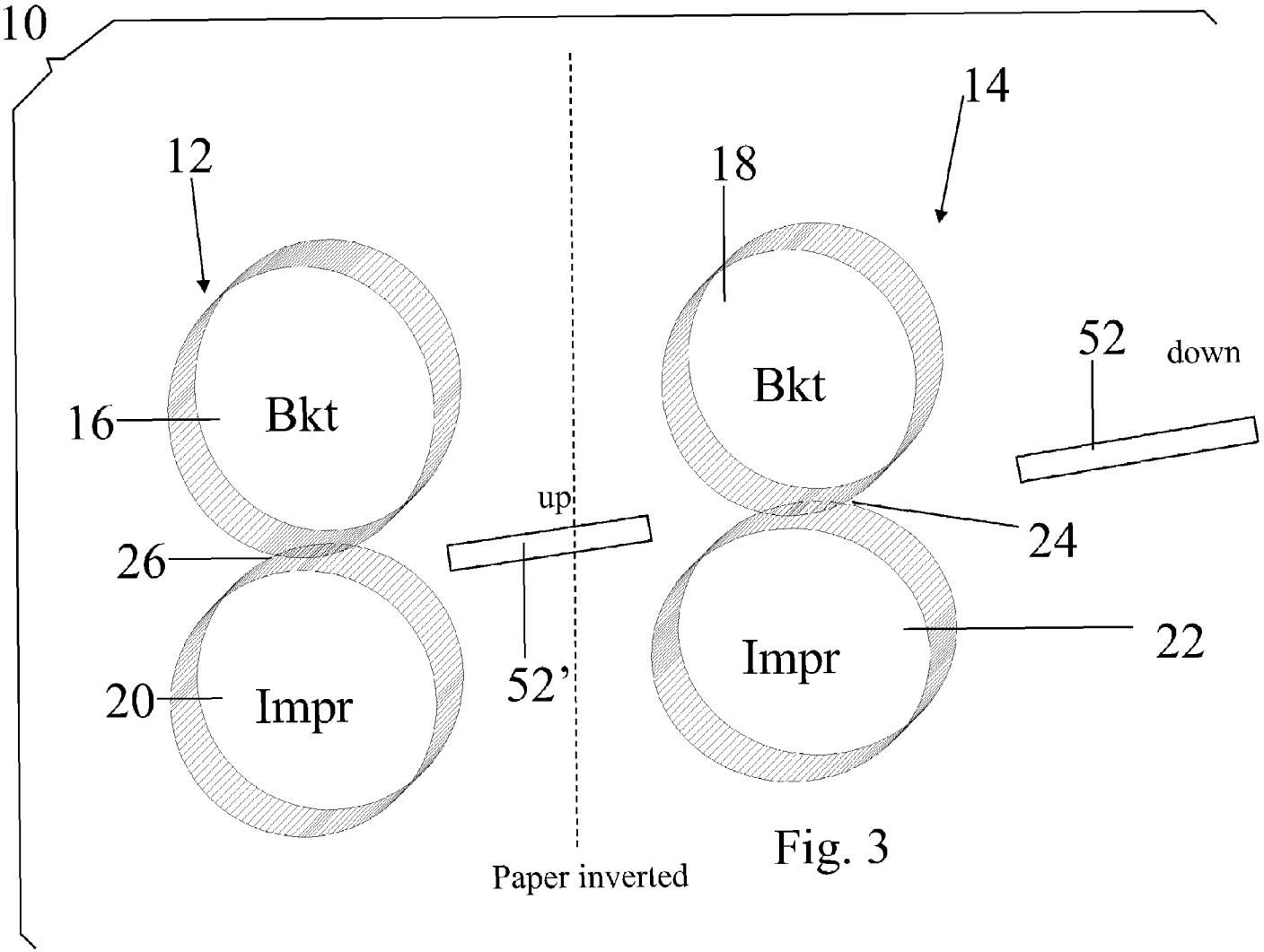
FIG. 3 is a simplified diagram showing the same dual engine printer with a following sheet being fed through said engines according to the embodiment of FIG. 1.

Reference is now made to FIG. 3, which is a simplified diagram illustrating the same view of the dual engine printer as FIG. 1 but showing a mode for printing each alternate sheet of the print job. Specifically the figure shows the alternate sheet 52 with an opposite orientation to that of preceding sheet 50. That is to say instead of printing the upside first and then the downside, the alternate sheet is printed downside first 52 and upside second 52'.

Thus table 1 is now modified to become the following:

TABLE 2

Printing Schedule, 6-1 imbalanced dual side printing, with Alternation

| | Page No | | | |
|---|---|---|---|---|
| | 1 | 2 | 3 | 4 |
| 1st Engine | 6 separations | 1 separations | 6 separations | 1 separations |
| 2nd Engine | 1 separation | 6 separation | 1 separation | 6 separation |
| Wait cycle 2nd Engine | 5 cycles | 0 | 0 | 0 |

Ignoring the first sheet, the utilization efficiency is now greatly increased since the second engine does not have to wait for the first engine. The utilization is in fact now 100%, leading to practically double the throughput through the dual engine printer. Thus the scheduling system of the present embodiment in fact allows a single printer to achieve a throughput that would have required two machines working together in the prior art.

Figure 4:
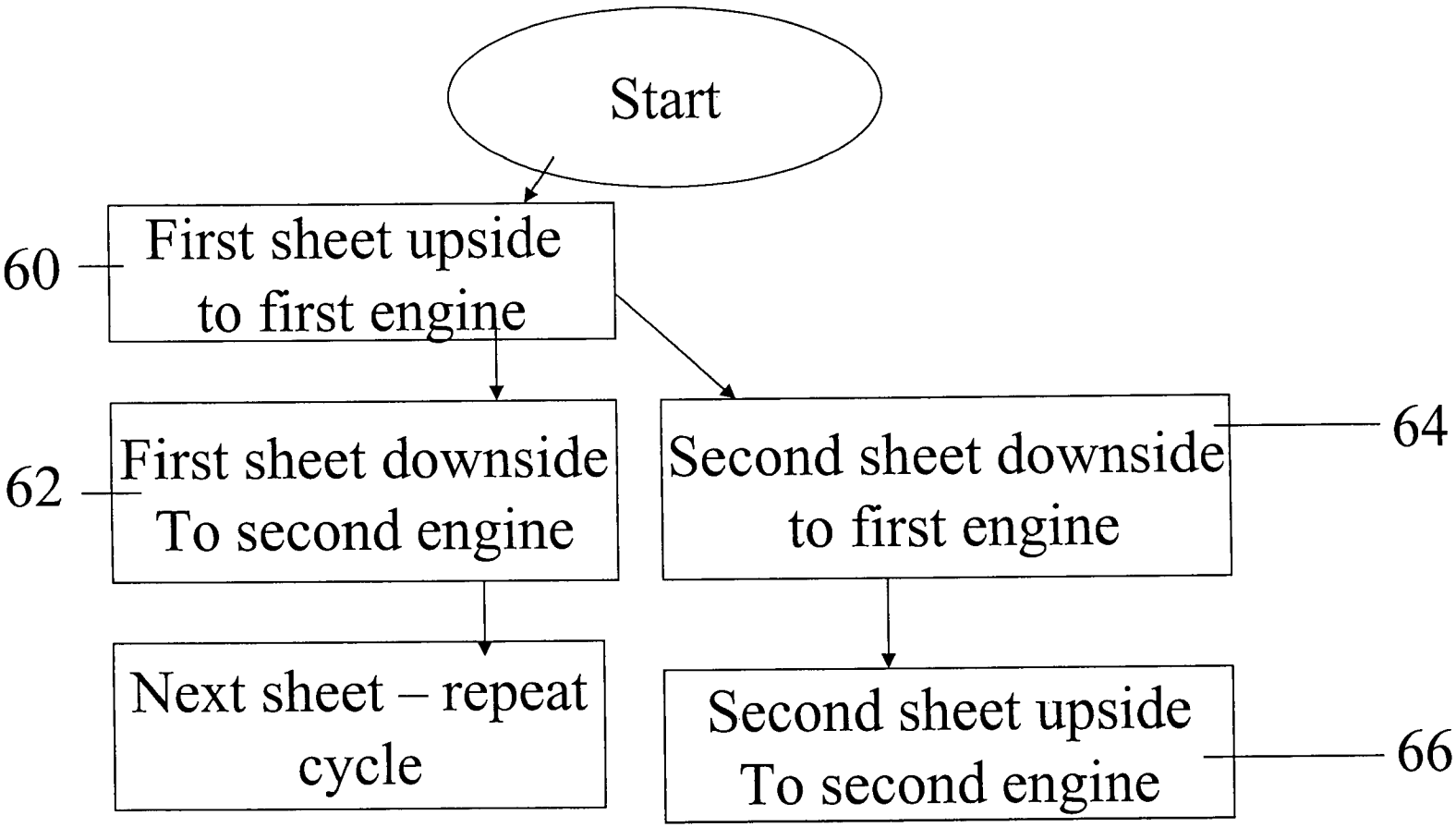
FIG. 4 is a simplified diagram showing a flow chart of dual side color printing scheduled according to a second embodiment of the present invention.

Reference is now made to FIG. 4, which is a simplified diagram illustrating a flow chart of the scheduling system for imbalanced printing according to the present embodiments. The method comprises feeding the sheets of the current print job in sequence between the print engines. The print engines then alternate for successive sheets (left hand and right hand sides of the figure respectively) between a) printing a first side at the first engine (stage 60) and the second side at the second engine (stage 62) on the one hand and b) printing the second side at the first engine (stage 64) and the first side at the second engine (stage 66) on the other hand.

It will be appreciated that the third page is treated as the first and the fourth page as the second, and so on.

It will be appreciated that designation of the two sides of the sheet as a first side and a second side is arbitrary but the point is that the different sides are printed alternately by the two engines.

As illustrated, feeding and alternating comprises feeding sheets through the two engines of the printer. As a first sheet reaches the first engine, its first side is printed, and then it is inverted and sent to the second engine where its second side is printed. For the next sheet the opposite is carried out. The second side is printed on the first engine and the first side is printed on the second engine. As soon as the first sheet is fed from the first engine the second sheet is fed onto the first engine, so that part of the printing is carried out simultaneously. Simultaneity is shown by the row direction in FIG. 4.

The result is a considerable increase in throughput of a dual or tandem printer for unbalanced dual sided printing jobs. Unbalanced printing jobs are relatively common in the printing world. Scheduling according to the present embodiments may be implemented automatically when the print controller determines that a different number of separations is needed for either side in a given print job.

Thus the improved throughput may be achieved by a simple programming modification to the print controller and no hardware changes are necessary. Following printing the alternate sheets are opposite ways up, which could lead to inconvenient handling of the printed sheets at the output. Convenient ways of handling which may be implemented include the following:

In one embodiment the alternate sheets may be inverted prior to output, resulting in all of the sheets being the same way up.

In another embodiment, the alternate sheets may be directed to separate parts of the stacker to form two separate piles of sheets. The operator then merely needs to take care to invert one of the piles.

Other possibilities for outputting the paper will occur to the skilled person.

The above has been described in terms of large invariant print jobs, but it is also possible to have a series of smaller print jobs or varying print jobs. A series of print operations can be programmed in advance and it is possible to program the scheduling and collation systems to look ahead a certain number of print operations in order to plan the scheduling, and corresponding collation.

In an embodiment the printer is able to look ahead by seven print operations in order to schedule the printing.

It is expected that during the life of this patent many relevant color printing devices and scheduling systems will be developed and the scope of the corresponding terms herein is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. In a dual engine color printer having a first print engine and a second print engine, each engine comprising a single multi-color printing drum set, a scheduling method for imbalanced dual sided printing of a plurality of sheets in a print job, in which a first side of each sheet of said plurality requires a first set of separations and a second side thereof requires a second set of separations, said first and second sets having different numbers of separations, the method comprising:

feeding respective ones of said plurality of sheets in sequence between said print engines, and alternating for successive sheets between printing said first set at said first engine and said second set at said second engine and printing said second set at said first engine and said first set at said second engine, wherein said feeding and alternating comprises repetitively until said print job is complete:

feeding one of said plurality of sheets to said first engine, and printing said first number of separations on a first side thereof;

subsequently, feeding said one sheet to said second engine, and printing said second number of separations on a second side thereof;

simultaneously with said feeding of said one sheet to said second engine, feeding a following one of said plurality of sheets to said first engine, and printing said second number of separations on a first side thereof; and subsequently feeding said following sheet to said second engine, and printing said first number of separations on a second side thereof.

2. The method of claim 1, further comprising inverting respective alternate sheets for output.

3. The method of claim 1, further comprising feeding respective alternate sheets to alternate output sites.

4. The method of claim 1, further comprising looking ahead to succeeding print operations to spot imbalances in said succeeding print operations and applying or not applying said feeding and alternating accordingly.

5. A controller for a dual engine color printing machine, the dual engine printing machine comprising a first color print engine and a second color print engine, each engine comprising a single multi-color printing drum, the controller having a mode for imbalanced dual sided printing, said imbalanced dual sided printing being a case in which a first side of each sheet of said plurality requires a first set of separations and a second side thereof requires a second set of separations, said first and second sets having different numbers of separations, the mode comprising:

a control operation applied to a sheet feeding mechanism for feeding respective ones of said plurality of sheets in sequence between said print engines, and a control operation applied to said print engines for alternating for successive sheets between printing said first set at said first engine and said second set at said second engine and printing said second set at said first engine and said first set at said second engine, wherein said control operation of feeding and alternating applied to said engines comprises repetitively until said print job is complete:

feeding one of said plurality of sheets to said first engine, and printing said first number of separations on a first side thereof;

subsequently, feeding said one sheet to said second engine, and printing said second number of separations on a second side thereof;

simultaneously with said feeding of said one sheet to said second engine, feeding a following one of said plurality of sheets to said first engine, and printing said second number of separations on a first side thereof; and subsequently feeding said following sheet to said second engine, and printing said first number of separations on a second side thereof.

6. The controller of claim 5, further operable to provide an output feed signal to control output feeding of said sheets such as to invert alternate sheets between printing and output.

7. The controller of claim 5, further operable to provide an output feed signal to control output feeding of said sheets to deliver alternate sheets to different output sites.

8. The controller of claim 5, further comprising a look-ahead function for looking ahead to successive print operations to determine a presence or absence of imbalances therein and to apply or not apply said mode accordingly.

9. A dual engine color printing machine comprising a first color print engine and a second color print engine, each engine comprising a single multi-color printing drum, and a controller, the controller having a mode for imbalanced dual sided printing, said imbalanced dual sided printing being a case in which a first side of each sheet of said plurality requires a first set of separations and a second side thereof requires a second set of separations, said first and second sets having different numbers of separations, the mode comprising:

a control operation applied to a sheet feeding mechanism for feeding respective ones of said plurality of sheets in sequence between said print engines, and a control operation applied to said print engines for alternating for successive sheets between printing said first set on a first side of a first sheet at said first engine and printing said second set on a second side of said first sheet at said second engine, and printing said second set on a first side of a second sheet at said first engine and printing said first set on a second side of said second sheet at said second engine.

* * * * *